US010646743B2

(12) United States Patent
Miller

(10) Patent No.: US 10,646,743 B2
(45) Date of Patent: May 12, 2020

(54) MOBILE ATHLETIC TRAINING TABLE

(71) Applicant: MILLCO DESIGNS, LLC, Upper Sandusky, OH (US)

(72) Inventor: Peter J. Miller, Upper Sandusky, OH (US)

(73) Assignee: MILLCO DESIGNS, LLC, Upper Sandusky, OH (US)

( * ) Notice: Subject to any disclaimer, the term of this patent is extended or adjusted under 35 U.S.C. 154(b) by 125 days.

(21) Appl. No.: 15/983,521

(22) Filed: May 18, 2018

(65) Prior Publication Data

US 2018/0339185 A1 Nov. 29, 2018

Related U.S. Application Data

(60) Provisional application No. 62/509,916, filed on May 23, 2017.

(51) Int. Cl.
*A63B 21/00* (2006.01)
*A63B 1/00* (2006.01)

(52) U.S. Cl.
CPC ..... *A63B 21/4029* (2015.10); *A63B 1/00* (2013.01); *A63B 2210/58* (2013.01)

(58) Field of Classification Search
CPC ..... A47B 2/00; A47B 2/08; A47B 2/0913; A47B 2003/0821–0827; A47C 11/00; A47C 9/002–005; A63B 21/4029–4031; A61G 13/009; A61G 13/105; A61H 37/00
See application file for complete search history.

(56) References Cited

U.S. PATENT DOCUMENTS

| | | | | |
|---|---|---|---|---|
| 3,661,100 | A * | 5/1972 | Tennant | A47B 3/0917 108/132 |
| 4,833,998 | A | 5/1989 | Everett et al. | |
| 5,283,919 | A | 2/1994 | Grant | |
| 5,660,121 | A * | 8/1997 | Botts | A47B 3/0918 108/123 |
| 7,458,452 | B2 * | 12/2008 | Beakey | A45C 13/002 150/105 |
| 7,591,763 | B1 * | 9/2009 | Fucci | A63B 21/0552 482/121 |
| 2004/0135416 | A1 * | 7/2004 | Parker | A47C 9/002 297/377 |
| 2008/0004168 | A1 * | 1/2008 | Jackson | A47C 9/002 482/148 |
| 2015/0238007 | A1 * | 8/2015 | Faller | A47B 3/0912 108/14 |

* cited by examiner

*Primary Examiner* — Jennifer Robertson
(74) *Attorney, Agent, or Firm* — Jacob M. Ward; Ward Law Office LLC

(57) ABSTRACT

An athletic training table has a main body with a padded weather resistant platform attached to a frame with a handle and wheels. The frame further has first legs and second legs rotatably connected thereto. The first legs and the second legs each have a first leg portion and a second leg portion. The first leg portion and the second leg portion, on both the first legs and the second legs, are connected by a cross-support member and a base support member. The first legs and the second legs are attached to a central telescopic member that expands and contracts as the first legs and the second legs are rotated between a folded position and an unfolded position.

17 Claims, 4 Drawing Sheets

MOBILE ATHLETIC TRAINING TABLE

CROSS-REFERENCE TO RELATED APPLICATIONS

This application claims the benefit of U.S. Provisional Application No. 62/509,916, filed on May 23, 2017. The entire disclosure of the above application is hereby incorporated herein by reference.

FIELD

The present disclosure relates to a table and, more particularly, to an athletic training table that is mobile.

BACKGROUND

Sports related injuries affect millions of people every year. At many athletic facilities and sporting events, trainers and medical personnel are waiting on the sidelines to aid an injured player. When injured, the athlete is taken off the field and is often placed on a table for examination and treatment. The tables used by trainers and medical personnel need to be easy to assemble and transport, as well as withstand outdoor weather conditions.

Portable tables designed for patient examination are generally known. For example, U.S. Pat. No. 4,833,998 to James Everett discloses a collapsible, padded massage table that can fold in half for storage. Also, U.S. Pat. No. 5,283,919 to Fred Grant discloses a trauma stretcher that is both foldable and maneuvers using wheels. However, these portable tables are not able to withstand outdoor weather conditions or travel over uneven ground.

There is a continuing need for a rugged athletic training table that is easily transportable. Desirably, the training table permits athlete examinations and treatments near the field of play.

SUMMARY

In concordance with the instant disclosure, a mobile athletic training table that is easily transportable, and which can support athlete examinations and treatments near the field of play, has been surprisingly discovered.

In one embodiment, a mobile athletic training table includes a main body with a padded weather resistant platform. The platform is attached to a frame with a handle and wheels. The mobile athletic training table further has first legs and second legs rotatably coupled to the frame, and positionable between a folded position for storage and transport, and an unfolded position for end use. The first legs and the second legs each contain a first leg portion and a second leg portion. The first leg portion and the second leg portion, on both the first legs and the second legs, are connected by a cross-support member and a base support member. The cross-support member on both the first legs and the second legs is attached to a central telescopic member. The central telescopic member includes a first member and a second member, with the first member slidably disposed inside the second member. The first member is selectively secured to the second member of central telescopic member using a locking mechanism. The locking mechanism may be a spring-loaded pin attached to a knob, or can be a threaded rod attached to a handle, as non-limiting examples. When ready for use, the first legs and second legs are unfolded, extending the central telescopic member. The locking mechanism is then engaged, securing the legs in place.

In another embodiment, the mobile athletic training table is sheltered from damage during transportation and storage using a protective covering. The covering is configured to envelope the athletic training table, while also having an aperture through which the handle may be gripped during transport. The platform can also be covered with a removable cleat protector that is configured to cover an end portion of the platform. The cleat protector guards the fabric of the platform against damage from athletic shoes worn by an athlete when laying or sitting upon the table for examination.

In a further embodiment, the athletic training table contains end plates connecting the first leg portion to the second leg portion on both the first legs and the second legs. The end plates are used for customized labeling or advertising, and further add stability to the legs.

DESCRIPTION OF THE DRAWINGS

The above, as well as other advantages of the present invention, will become clear to those skilled in the art from the following detailed description of a preferred embodiment when considered in the light of the accompanying drawings in which.

DETAILED DESCRIPTION

The following detailed description and appended drawings describe and illustrate various exemplary embodiments of the invention. The description and drawings serve to enable one skilled in the art to make and use the invention and are not intended to limit the scope of the invention in any manner. In respect of the methods disclosed, the steps presented are exemplary in nature and, thus, the order of the steps is not necessary or critical unless otherwise disclosed.

In the description, relative terms such as "lower," "upper," "horizontal," "vertical,", "above," "below," "up," "down," "top" and "bottom" as well as derivatives thereof (e.g., "horizontally," "downwardly," "upwardly," etc.) should be construed to refer to the orientation as then described or as shown in the related drawing. These relative terms are for convenience of description and do not require that the apparatus be constructed or operated in a particular orientation. Terms concerning attachments, such as "connected," "connecting," "coupled," "linked" and "coupling" are used interchangeably and refer to one structure or surface being secured to another structure or surface, unless expressly described otherwise.

FIGS. 1-11 disclose a mobile athletic training table 1 according to one embodiment of the disclosure. The table 1 has a main body 2 with a platform 4 and a frame 6. The frame 6 has a first end and a second end. The platform 4 of the main body 2 is attached to the frame 6 and extends over the first end and the second end (see FIGS. 2-4 and 10).

Figure 3:
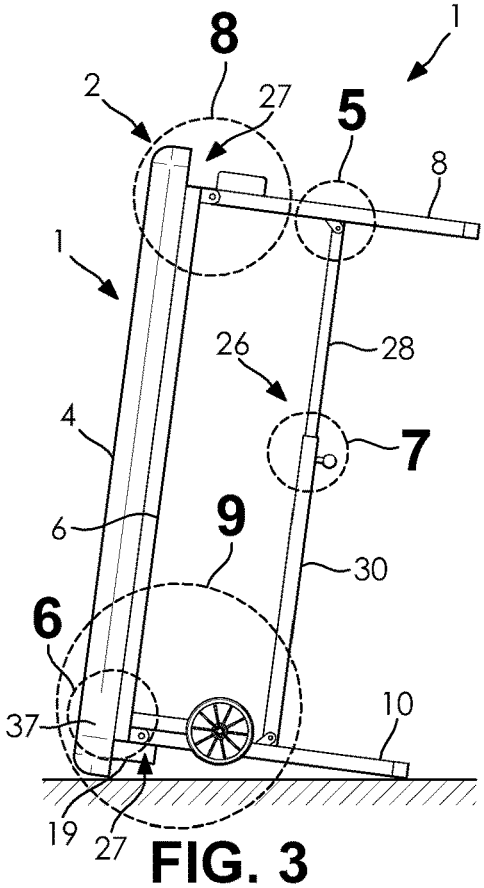
FIG. 3 is a left side elevational view of the mobile athletic training table of FIG. 1, with both first and second legs extended, and the central telescopic member extended and locked in place between the first and second extended legs, where the mobile athletic training table is vertically resting on a base support member of the second legs and the foot end of the mobile athletic training table.
Figure 4:
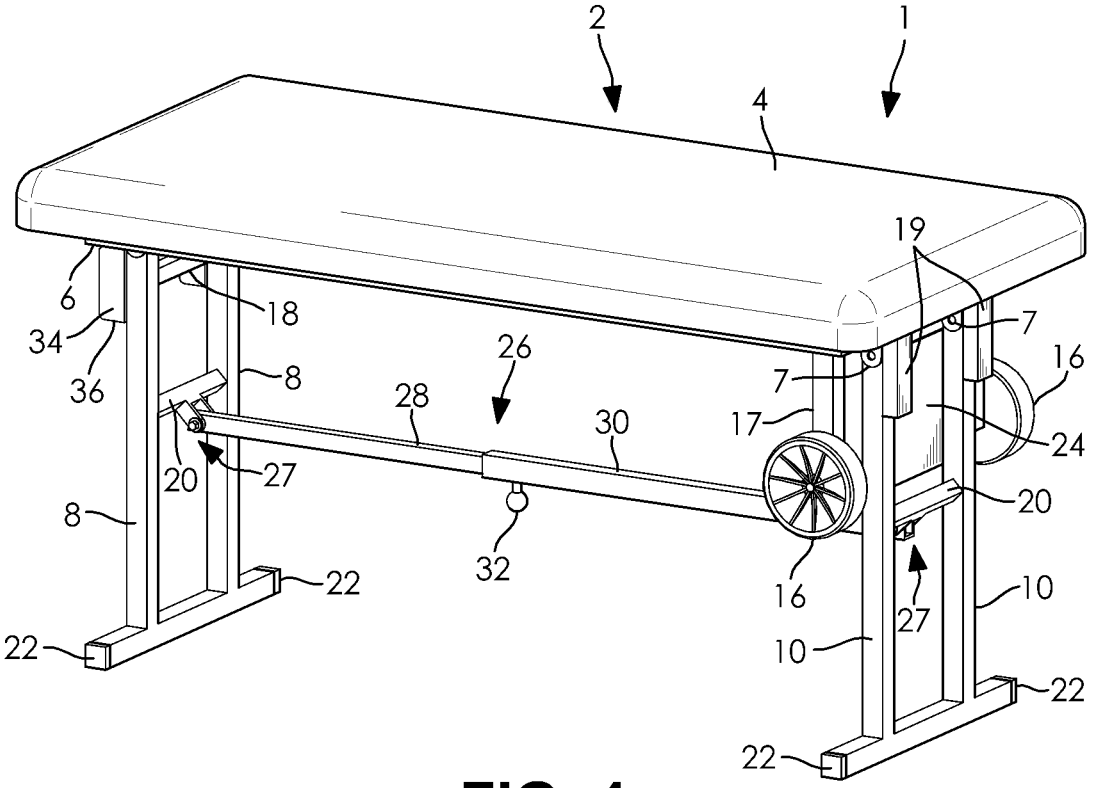
FIG. 4 is a top perspective view of the mobile athletic training table of FIG. 3, with the mobile athletic training table resting on both first and second base support members.

As an overview, FIG. 3 and its associated views FIGS. 4-10 illustrate the mobile athletic training table 1 having both first and second legs 8, 10 extended, and a central telescopic member 26 extended and locked in place between the first and second extended legs 8, 10. The mobile athletic training table 1 is shown in FIG. 3 vertically resting on a base support member 22 of the second leg 10 at the foot end of the mobile athletic training table 1. FIG. 4 is a full top view of the mobile athletic training table 1 resting on both first and second base support members 22, and in a position that is ready for use.

Figure 5:
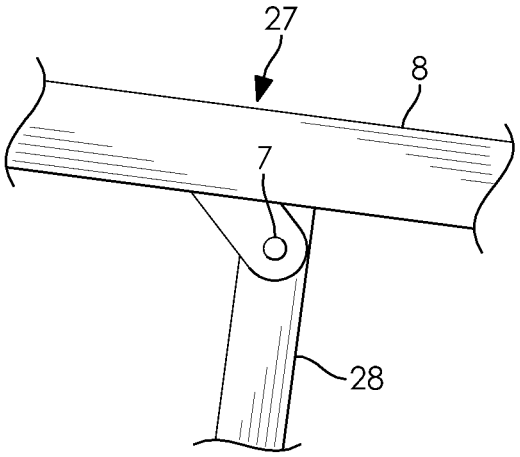
FIG. 5 is an enlarged fragmentary view taken at call-out 5 in FIG. 3, and showing a coupling between the central telescopic member and the first legs.
Figure 6:
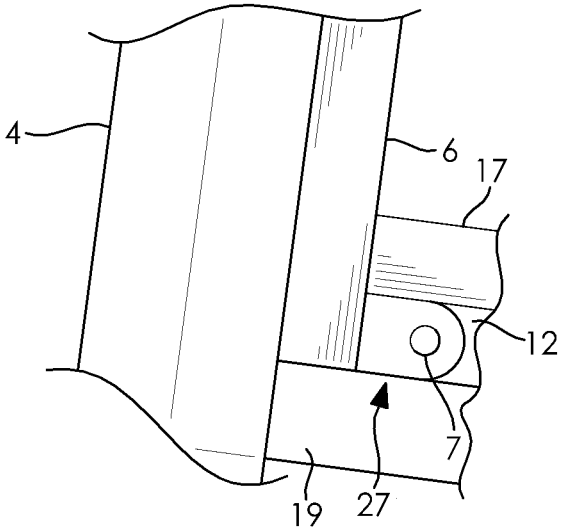
FIG. 6 is an enlarged fragmentary view taken at call-out 6 in FIG. 3, and showing a coupling between a frame of the mobile athletic training table and the second legs.
Figure 7:
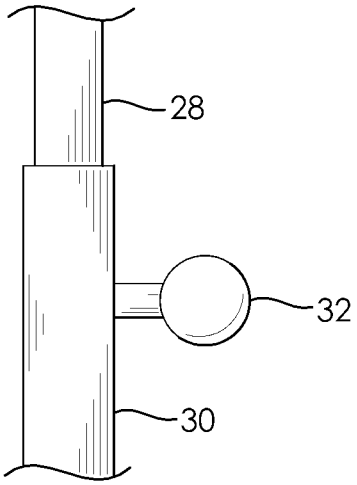
FIG. 7 is an enlarged fragmentary view taken at call-out 7 in FIG. 3, and showing a coupling between a first telescopic member and a second telescopic member secured by way of a spring-loaded pin type locking mechanism.

FIG. 5 is an enlarged fragmentary call-out view of FIG. 3 showing a coupling 27 between the central telescopic member 26 and the first legs 8. FIG. 6 is enlarged fragmentary call-out view of FIG. 3 showing a coupling 27 between the frame 6 and a first leg portion 12 of the second leg 10. FIG. 7 is enlarged fragmentary call-out view of FIG. 3 showing an area between a first telescopic member 28 and a second telescopic member 30 secured by way of a locking mechanism 32.

Figure 8:
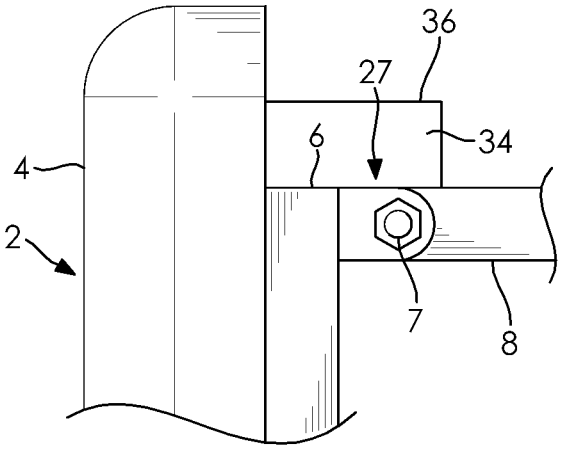
FIG. 8 is an enlarged fragmentary view taken at call-out 8 of FIG. 3, and showing a coupling between a head end of the frame and a top end of the first legs.
Figure 9:
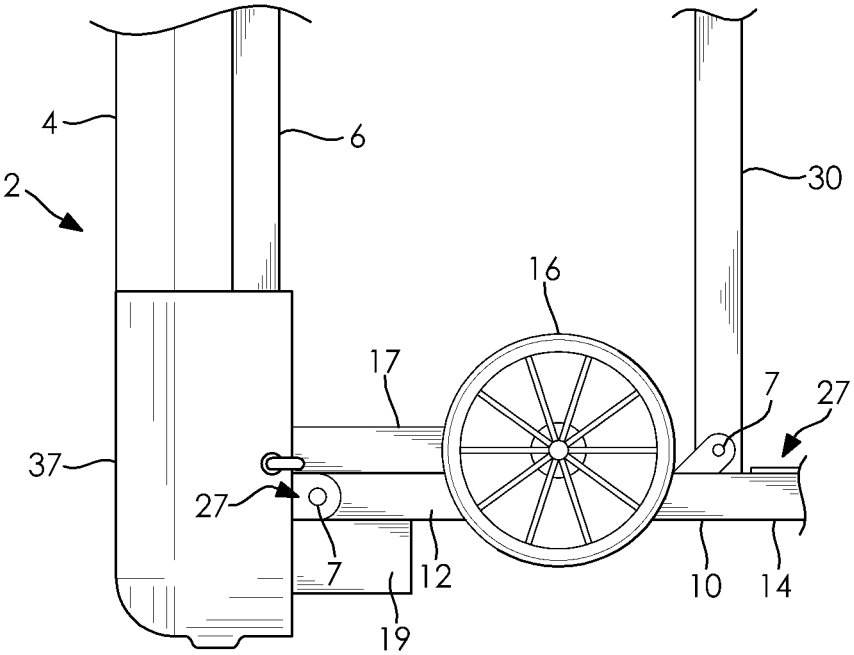
FIG. 9 is an enlarged fragmentary view taken at call-out 9 in FIG. 3, and showing a coupling between a foot end of the frame and a top end of the second legs, with a roller leg and a cleat cover.
Figure 10:
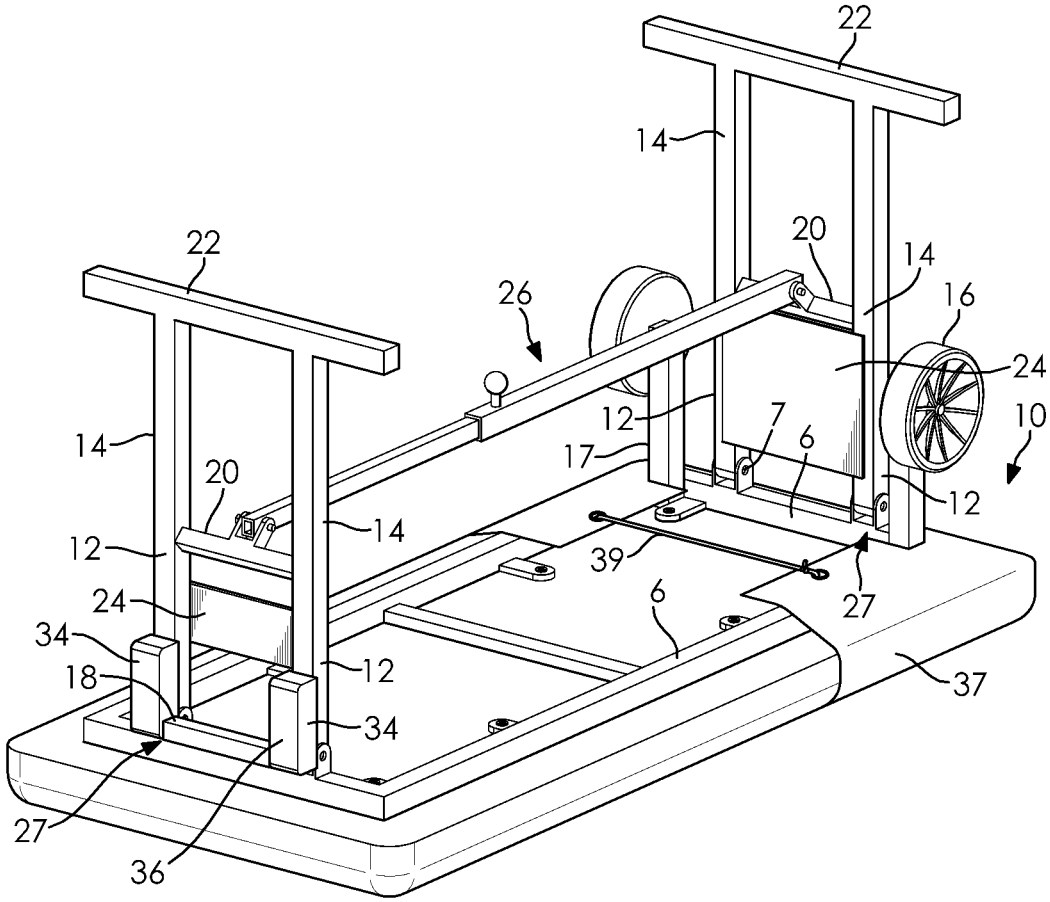
FIG. 10 is a bottom perspective view of the mobile athletic training table of FIG. 1, shown with the cleat cover of FIG. 9.

FIG. 8 is enlarged fragmentary call-out view of FIG. 3 showing a coupling 27 between a head end of the frame 6 and a first portion 12 of the first leg 8. FIG. 9 is enlarged fragmentary call-out view of FIG. 3 showing a coupling between a foot end of the frame 6 and a top portion 12 of the second leg 10, with a roller leg 17 and a cleat cover 37. FIG. 9 further shows a coupling 27 between the second telescopic member 30 and the second legs 10. FIG. 10 is a full bottom view of the mobile athletic training table 1 of FIG. 4 with the cleat cover 37 of FIG. 9.

Generally, the frame 6 may be connected to the platform 4 with fasteners 7 such as, for example, screws, bolts, adhesives, or the like. In certain embodiments, the platform 4 can be padded and made of a weather resistant material, for example a marine leather or medical-grade vinyl material. At the end of the platform 4 adjacent to the wheels 16, there may also be an additional layer for leather or vinyl material providing a protective stair nosing (not shown), which keeps the underlying leather or vinyl of the platform 4 from tearing when the platform 4 is stood up on that end. A skilled artisan may select other suitable types of fasteners and materials for the platform 4, as desired.

The table 1 further has foldable legs 8, 10 that are attached to the frame 6. Each of the first legs 8 and the second legs 10 may include the first leg portion 12 and the second leg portion 14 (see FIGS. 4 and 10). The first legs 8 are rotatably attached to the frame 6 at a first end of the table 1, and the second legs are rotatably attached to the frame 6 at a second end of the table 1. The legs 8, 10 of the athletic training table 1 may be retracted to a folded position disposed adjacent to the platform 4 and the frame 6 for transport and storage (see FIGS. 1 and 2), and then extended to an unfolded position and used to support the weight of a patient during an examination or treatment.

The first legs 8 are rotatably coupled 27 to the first end of the frame 6, and the second legs 10 are rotatably coupled 27 to the second end of the frame 6. The rotatable coupling may be accomplished with fasteners 7 such as pins, bolts, or the like. Other suitable means for rotatably coupling the first legs 8 and the second legs 10 to the frame 6 may also be employed, as desired.

The second end of the frame 6 is further connected to rollers or wheels 16. The wheels 16, which are connected to the frame 6 with the roller legs 17 and a free rolling, permit the main body 2 to be easily rolled for transport when the legs 8, 10 are in the folded position. It should be appreciated that the roller legs 17 are different from the first and second legs 8, 10, and that the roller legs 17 are not rotatable or pivotable, but are instead fixed in position relative to the frame 6. The roller legs 17 are further spaced apart laterally from the second legs 10 when the second legs 10 are in the unfolded position. The legs 8, 10 are also configured to be disposed in a volume disposed between the wheels 16 and an underside of the frame 6 when the legs 8, 10 are in the folded position.

As shown in FIG. 10, the first end of the frame 6 is attached to a handle 18 that enables the user to grab the athletic training table 1 for easy transport. The handle 18 may be a substantially straight bar arranged next to the first legs 8, for example. In other embodiments, the handle 18 may be an upwardly angled U-shaped bar that permits for an easier gripping and pulling or pushing of the table 1 by an end user. In a most particular embodiment, the handle 18 is affixed to first extensions 34, as discussed further hereinbelow, which causes the handle 18 to be spaced apart from the frame 6 and facilitates a gripping of the handle 18 when the first legs 8 are in the folded position. One of ordinary skill in the art may select other suitable types and configurations for the handle 18, as desired.

As further shown in FIGS. 4 and 10, the first and second legs 8, 10 contain a cross-support member 20 and a base support member 22 that connect the first leg portion 12 to the second leg portion 14 of the respective first legs 8 and second legs 10. The base support member 22 provides an elongated surface for the first and second leg portions 12, 14 to contact the ground, thereby stabilizing the legs 8, 10 and platform 4 (see FIG. 4). In particular, the base support member 22 has a length greater than a length of the cross-support member 20, which results in enhanced stability of the table 1. The cross-support member 20 also connects the first and second leg portions 12, 14 to increase stability and rigidity of the platform 4.

The first and second legs 8, 10 are also each rotatably coupled 27 to the central telescopic member 26. The central telescopic member 26 contains a first member 28 and a second member 30. The first member 28 is slidably disposed inside of the second member 30. As the legs 8, 10 are moved between the folded position and the unfolded position, the first member 28 slides within and out of the second member 30. When the legs 8, 10 and the central telescopic member 26 are fully extended, the first and second telescopic members 28, 30 are then secured in place by the locking mechanism 32.

In a particular example, the first member 28 is rotatably attached to the cross-support member 20 by way of a bracket (shown in FIG. 4) that extends downwardly and inwardly from the cross-support member 20 relative to the first legs 8 when in the unfolded position. Likewise, the second member 30 is rotatably attached to the cross-support member 20 by way of a bracket (also shown in FIG. 4) that extends downwardly and inwardly from the cross-support member relative to the second legs 10 when in the unfolded position. It should be appreciated that the orientation of these brackets facilitates both the telescopic operation of the central telescopic member 26 and also a folding of the first and second legs 8, 10 into a substantially flat orientation relative to the frame 6 when in the folded position.

The locking mechanism 32 may include any suitable structure for selectively affixing the first and second telescopic members 28, 30 relative to each other. In one embodiment, the locking mechanism may include a spring-loaded pin type mechanism, which is connected to a knob that a user may pull to decouple the first and second telescopic members 28, 30, and which may be released to allow the pin to slide into aligned holes in the first and second telescopic members 28, 30 to couple the same. In another embodiment, the locking mechanism may include a threaded rod that has a handle which allows the user to rotate the handle and selective cause the threaded rod to impinge upon the first member 28 inside of the second member 30 to couple the same. Other types of locking mechanisms 32 are also contemplated and may be employed, as desired.

In certain embodiments, the first and second legs 8, 10 can also be fitted with end plates 24 that connect the first leg portion 12 to the second leg portion 14. The end plates 24 add further rigidity to the legs 8, 10, and further provide space for customized labeling or advertisement.

In certain embodiments, the table 1 may also have first extensions 34, for example, as shown in FIGS. 4 and 8. The first extensions 34 are affixed to the first legs 8 and may have rubber bumpers 36 that prevent the bottom of the main body 2 from scratching objects while in storage.

Furthermore, as shown in FIGS. 3-4, 6, and 9-10, the frame 6 may have second extensions 19 that are configured to abut the legs 10 and keep the legs 10 oriented substantially perpendicular to the platform 4 when fully extended. The second extensions 19 function as a hard stop to prevent over-rotation of the second legs 10 beyond the unfolded position. The second extensions 19 are affixed to the frame 6 and depend from or otherwise extend downwardly from the frame 6 a distance that is less than a distance which the roller legs 17 extend, so as to not interfere with the ability of the table 1 to be rolled when in the collapsed position.

In a particular embodiment, as shown in FIGS. 9 and 10, and to further protect the platform 4, the athletic training table 1 can be fitted with the cleat cover 37, which guards the material against athletic cleats of an athlete while being examined or treated.

Figure 11:
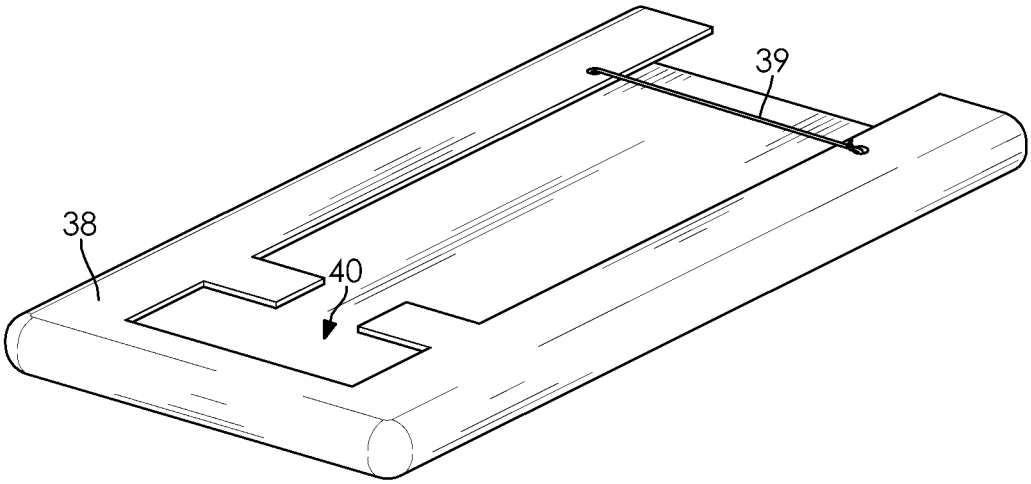
FIG. 11 is a bottom perspective view a protective covering for the mobile athletic training table, the protective covering having an aperture.

The athletic training table 1 may further be selectively protected with a covering 38 that guards the athletic training table 1 during storage and travel (see FIG. 11). The covering 38 may be formed from a weather-resistant woven or non-woven cloth, for example. The covering 38 is configured to substantially envelope the platform 4 of the athletic training table 1. The covering 38 may further have an aperture 40 through which a user is permitted to grab the handle 18 (see FIG. 10). As shown in both FIGS. 10 and 11, a line 39 such as a bungee cord or rope can also be used to keep the cleat cover 37 and the protective covering 38 attached to the athletic training table 1.

Figure 1:
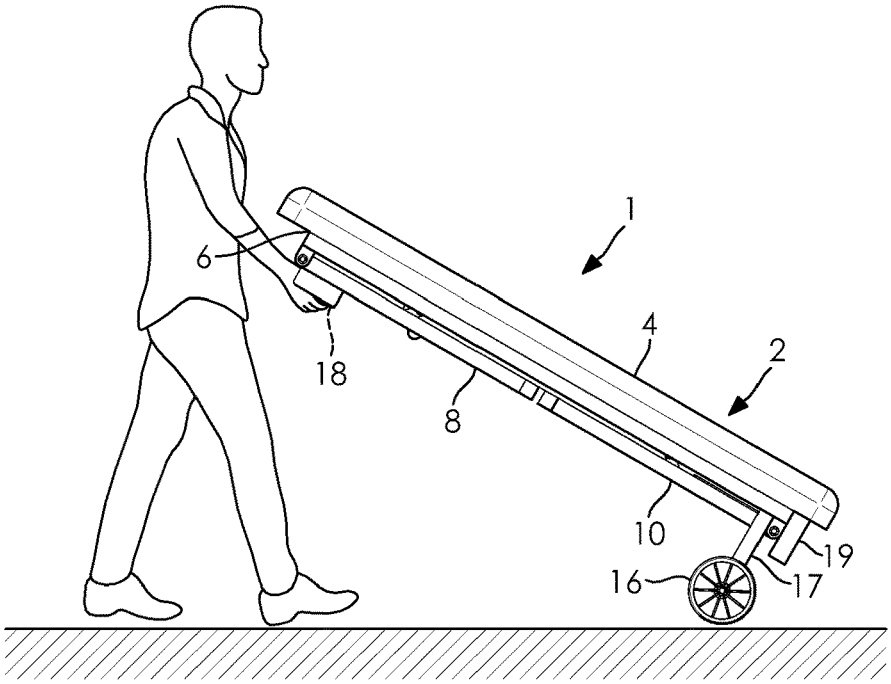
FIG. 1 is a side elevational view of an individual transporting a mobile athletic training table showing both first and second legs collapsed thereunder, where the mobile athletic training table is being transported on wheels by the individual.

In operation, the athletic training table 1 is transported in the folded position by orienting the main body 2 to where the wheels 16 engages the ground, and directing the athletic training table 1 in the desired direction using the handle 18 (see FIG. 1). Once the user has arrived at area of use, the covering 38 is removed and the first and second legs 8, 10 are unfolded to the unfolded position, thereby extending the central telescopic member 26 until the legs 8, 10 abut the extensions 34 on the frame 6 (see FIGS. 1, 4, and 8). The locking mechanism 32 is then engaged, thereby securing the legs 8, 10 in the unfolded position substantially perpendicular to the platform 4. The athletic training table 1 is then oriented to where the base support members 22 engage the ground (see FIG. 4). The athletic training table 1 is thereby ready to support patients during an examination or treatment.

Figure 2:
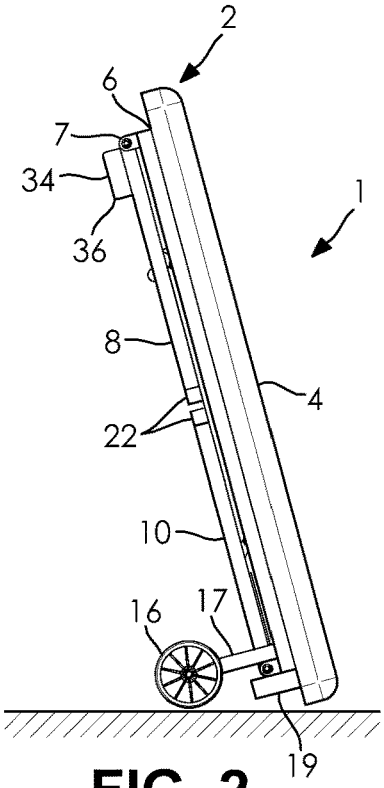
FIG. 2 is a right side elevational view of the mobile athletic training table of FIG. 1 resting substantially upright or vertically on the wheels and the foot end of the mobile athletic training table.

When use of the athletic training table 1 by the user is completed, the locking mechanism 32 is disengaged and the first and second legs 8, 10 are collapsed so they lay substantially flat upon the main body 2 in the folded position (see FIGS. 1 and 2). The locking mechanism 32 may then be then engaged, locking the first and second legs 8, 10 in the folded position. The protective covering 38 is pulled over the athletic training table 1. The athletic training table 1 may then be rolled to storage for future use (see FIG. 1).

Advantageously, the mobile athletic training table 1 of the present disclosure is easily transportable while in the folded position, and can support patient examinations and treatments near the field of play in the unfolded position. Although described herein primarily with respect to athletic training and treatment during athletic events or practices, it should be appreciated that the table 1 of the present disclosure may also be employed in other environments, and its use is not limited to athletic events or practices.

While certain representative embodiments and details have been shown for purposes of illustrating the invention, it will be apparent to those skilled in the art that various changes may be made without departing from the scope of the disclosure, which is further described in the following appended claims.

What is claimed is:

1. A mobile athletic training table, comprising:

a main body having a platform and a frame, the frame having a handle and wheels;

a pair of first legs and a pair of second legs, the first legs connected to the second legs by a central telescopic member, and each of the first legs and the second legs having an upper end rotatably connected to the frame and positionable between an unfolded position and a folded position, and each of the first legs and the second legs having a bottom end configured to support the main body in the unfolded position;

a pair of first extensions affixed to the first legs at a first end of the main body, each of the pair of first extensions disposed adjacent the upper end of one of the first legs, and each of the pair of first extensions militates against a bottom of the main body being damaged while in storage; and a pair of second extensions depending from the frame at a second end of the main body, the second extensions configured to abut the upper end of each of the second legs when in the unfolded position and function as a hard stop to militate against over-rotation of the second legs beyond the unfolded position.

2. The mobile athletic training table of claim 1, wherein the central telescopic member has a first member and a second member, the first member slidably disposed inside the second member, and the central telescopic member has a locking mechanism configured to selectively secure the first member inside the second member.

3. The mobile athletic training table of claim 2, wherein each of the first legs and the second legs have a first leg portion and a second leg portion, the first leg portion and the second leg portion connected by a cross-support member and a base support member.

4. The mobile athletic training table of claim 3, wherein the first member of the central telescopic member is rotatably attached to the cross-support member of the first legs.

5. The mobile athletic training table of claim 4, wherein the attachment of the first member to the cross-support member of the first legs is made by a bracket extending downwardly and inwardly from the cross-support member relative to the first legs when in the unfolded position.

6. The mobile athletic training table of claim 3, wherein the second member of the central telescopic member is rotatably attached to the cross-support member of the second legs.

7. The mobile athletic training table of claim 6, wherein the attachment of the second member to the cross-support member of the second legs is made by a bracket extending downwardly and inwardly from the cross-support member relative to the second legs when in the unfolded position.

8. The mobile athletic training table of claim 3, wherein the first leg portion is further connected to the second leg portion by an end plate.

9. The mobile athletic training table of claim 3, wherein the base support member has a length greater than a length of the cross-support member.

10. The mobile athletic training table of claim 1, wherein the platform contains padding and is covered in a weather resistant material.

11. The mobile athletic training table of claim 1, wherein a portion of the platform is selectively covered by a removable cleat protector, and the cleat protector is configured to attach to the platform.

12. The mobile athletic training table of claim 1, wherein the main body is selectively enveloped in a removable covering, and the covering having an aperture through which the handle of the main body is disposed when the first legs and the second legs are in the folded position.

13. The mobile athletic training table of claim 1, wherein the handle is attached to and disposed between the first extensions.

14. The mobile athletic training table of claim 1, further comprising a pair of roller legs depending from the frame at a second end of the main body, the wheels freely rotatably connected to the roller legs.

15. The mobile athletic training table of claim 14, wherein the roller legs are spaced laterally apart from the second legs when in the unfolded position.

16. A mobile athletic training table, comprising:

a main body having a platform and a frame, the frame having a handle and wheels;

a pair of first legs and a pair of second legs, the first legs connected to the second legs by a central telescopic member, and each of the first legs and the second legs having an upper end rotatably connected to the frame and positionable between an unfolded position and a folded position, and each of the first legs and the second legs having a bottom end configured to support the main body in the unfolded position;

a pair of first extensions affixed to the first legs at a first end of the main body, each of the pair of first extensions disposed adjacent the upper end of one of the first legs, and each of the pair of first extensions militates against a bottom of the main body being damaged while in storage; and a pair of second extensions depending from the frame at a second end of the main body, the second extensions configured to abut the upper end of each of the second legs when in the unfolded position and function as a hard stop to militate against over-rotation of the second legs beyond the unfolded position, wherein the central telescopic member has a first member and a second member, the first member slidably disposed inside the second member, and the central telescopic member has a locking mechanism configured to selectively secure the first member inside the second member, wherein each of the first legs and the second legs have a first leg portion and a second leg portion, the first leg portion and the second leg portion connected by a cross-support member and a base support member, wherein the first member of the central telescopic member is rotatably attached to the cross-support member of the first legs, wherein the attachment of the first member to the cross-support member of the first legs is made by a bracket extending downwardly and inwardly from the cross-support member relative to the first legs when in the unfolded position, wherein the second member of the central telescopic member is rotatably attached to the cross-support member of the second legs, and wherein the attachment of the second member to the cross-support member of the second legs is made by a bracket extending downwardly and inwardly from the cross-support member relative to the second legs when in the unfolded position.

17. A mobile athletic training table, comprising:

a main body having a platform and a frame, the frame having a handle and wheels;

a pair of first legs and a pair of second legs, the first legs connected to the second legs by a central telescopic member, and each of the first legs and the second legs having an upper end rotatably connected to the frame and positionable between an unfolded position and a folded position, and each of the first legs and the second legs having a bottom end configured to support the main body in the unfolded position;

a pair of first extensions affixed to the first legs at a first end of the main body, each of the pair of first extensions disposed adjacent the upper end of one of the first legs, and each of the pair of first extensions militates against a bottom of the main body being damaged while in storage, wherein the handle is attached to and disposed between the first extensions;

a pair of second extensions depending from the frame at a second end of the main body, the second extensions configured to abut the upper end of each of the the second legs when in the unfolded position and function as a hard stop to militate against over-rotation of the second legs beyond the unfolded position; and a pair of roller legs depending from the frame at a second end of the main body, the wheels freely rotatably connected to the roller legs, wherein the roller legs are spaced laterally apart from the second legs when in the unfolded position.

* * * * *